US011376174B2

(12) United States Patent
Haddican et al.

(10) Patent No.: US 11,376,174 B2
(45) Date of Patent: Jul. 5, 2022

(54) WHEELCHAIR ACCESSORY APPARATUS

(71) Applicants: Edward Haddican, Staten Island, NY (US); Marc Erlenbach, Brooklyn, NY (US)

(72) Inventors: Edward Haddican, Staten Island, NY (US); Marc Erlenbach, Brooklyn, NY (US)

( * ) Notice: Subject to any disclaimer, the term of this patent is extended or adjusted under 35 U.S.C. 154(b) by 470 days.

(21) Appl. No.: 16/700,236

(22) Filed: Dec. 2, 2019

(65) Prior Publication Data

US 2021/0161751 A1 Jun. 3, 2021

(51) Int. Cl.

| | |
|---|---|
| ***A61G 5/10*** | (2006.01) |
| ***A61G 5/14*** | (2006.01) |
| ***A61H 3/02*** | (2006.01) |

(52) U.S. Cl.

CPC ..... *A61G 5/10* (2013.01); *A61G 5/14* (2013.01); *A61H 3/0244* (2013.01); *A61H 2003/0255* (2013.01); *Y10S 297/04* (2013.01)

(58) Field of Classification Search

CPC ..... A61G 5/10; A61G 5/14

See application file for complete search history.

(56) References Cited

U.S. PATENT DOCUMENTS 2,556,121 A * 6/1951 Jean ..... A61G 5/10 482/68
2,596,055 A * 5/1952 Jean ..... A61G 5/14 482/68
3,405,954 A 10/1968 Wolfe
3,584,890 A 6/1971 Presty
3,719,390 A * 3/1973 Haney ..... A61G 5/1054 297/42
3,999,778 A * 12/1976 Markiel ..... A61H 3/04 280/43
4,809,804 A 3/1989 Houston et al.
5,137,102 A 8/1992 Houston et al.
5,411,044 A 5/1995 Andolfi
5,558,358 A 9/1996 Johnson
(Continued)

FOREIGN PATENT DOCUMENTS

CN 105105934 A * 12/2015
JP 3102745 U * 7/2004

*Primary Examiner* — Robert Canfield
(74) *Attorney, Agent, or Firm* — Michael J. Feigin, Esq.; Feigin and Fridman LLC

(57) ABSTRACT

A wheelchair accessory apparatus is disclosed. The wheelchair accessory apparatus includes an ambulatory assistive device retaining member removably attachable to the frame of a wheelchair and an ambulatory assistive device support member removably attachable to the footrest of a wheelchair. The ambulatory assistive device retaining member includes a first leg, a second leg, and an elongated stem. The first leg and the second leg join and define a portal therebetween to receive an ambulatory assistive device therethrough. The ambulatory assistive device support member includes a body comprising a cup sized to removably receive a crutch tip. When the ambulatory assistive retaining member and the ambulatory assistive device support member are both attached to the wheelchair, the portal and the cup align to receive and sustain an ambulatory assistive device therein for hands-free transportation of the ambulatory assistive device while utilizing a wheelchair.

19 Claims, 11 Drawing Sheets

(56) References Cited

U.S. PATENT DOCUMENTS

| | | | | |
|---|---|---|---|---|
| 5,605,345 | A | 2/1997 | Erfurth et al. | |
| 5,816,593 | A | 10/1998 | Che | |
| 6,601,865 | B1 * | 8/2003 | Harper | A61G 5/128 297/423.26 |
| 7,021,324 | B1 * | 4/2006 | Clay | A61H 3/04 135/66 |
| 7,481,445 | B1 | 1/2009 | Danziger | |
| 7,726,327 | B2 | 6/2010 | Battiston | |
| 8,998,244 | B2 | 4/2015 | Purdue | |
| 9,655,806 | B2 | 5/2017 | Naucke | |
| 9,750,653 | B1 | 9/2017 | Christmas et al. | |
| 10,765,587 | B2 * | 9/2020 | Gardner | A61H 3/04 |
| 10,806,651 | B2 * | 10/2020 | Hanley | A61G 5/128 |
| 2002/0134808 | A1 * | 9/2002 | Gallagher | B60R 11/00 224/502 |
| 2005/0098695 | A1 * | 5/2005 | Hollenbeck | A61H 3/0244 248/229.26 |
| 2009/0020575 | A1 * | 1/2009 | Katchen | A61G 5/10 224/407 |
| 2017/0332748 | A1 * | 11/2017 | Kaplan | A45B 9/04 |

* cited by examiner

WHEELCHAIR ACCESSORY APPARATUS

FIELD OF THE DISCLOSED TECHNOLOGY

The disclosed technology relates to a wheelchair accessory apparatus for attachment to a wheelchair. More specifically, the wheelchair accessory apparatus includes a retaining member and a support for placement and retainment of an ambulatory assistive device while a user is employing a wheelchair, thereby allowing transportation of the ambulatory assistive device by the wheelchair.

BACKGROUND OF THE DISCLOSED TECHNOLOGY

Individuals who need to, either permanently or temporarily, make use of a wheelchair for mobility generally have problems transporting their ambulatory assistive device along with them and the wheelchair. When employing a wheelchair, ambulatory assistive devices such as walkers, rolling walkers, crutches, and canes need to be held by the user. This limits the user's ability to effectively utilize the wheelchair and creates an unsafe condition for the user trying to manage an assistive device while operating a wheelchair. Indeed, in the majority or circumstances users require the aid of another individual to help them transport their assistive device while employing a wheelchair. Either the user pushes the wheelchair himself or herself, while the individual carries the assistive device, or the user carries the assistive device while the individual pushes the wheelchair. This can be awkward, uncomfortable, and in some cases painful, and effectively limits the independence and functional mobility of the individual in the wheelchair.

Accordingly, there is a need for a wheelchair accessory apparatus that is attachable to the frame of a wheelchair and includes a retaining member and support for placement and retainment of an ambulatory assistive device, thereby enabling a user to safely and transport their assistive device, without interference, while employing their wheelchair.

SUMMARY OF THE DISCLOSED TECHNOLOGY

Disclosed herein is a wheelchair accessory apparatus is a wheelchair accessory apparatus including an ambulatory assistive device retaining member removably attachable to the frame of a wheelchair and an ambulatory assistive device support member removably attachable to the footrest of a wheelchair. The ambulatory assistive device retaining member includes a first leg, a second leg, and an elongated stem. The first leg and the second leg are joined at a central point and define a portal therebetween to receive an ambulatory assistive device therethrough. The elongated stem removably attachable to a wheelchair frame. The ambulatory assistive device support member includes a body comprising a cup sized to removably receive a crutch tip. When the ambulatory assistive retaining member and the ambulatory assistive device support member are both attached to the wheelchair, the portal and the cup align to receive and sustain an ambulatory assistive device therein for transportation while in use with a wheelchair.

In embodiments, the ambulatory assistive device support member includes an aperture and a sleeve. In some embodiments, the first leg, the second leg, and the elongated stem are coplanar. In some embodiments, the first leg and the second leg join at the central point to form a U-shaped portion defining an arch therebetween, the central point disposed at a center of the arch. In other embodiments, the first leg and the second leg join at the central point to form a V-shaped portion defining an apex at the central point. In some embodiments, the elongated stem extends outwardly from the central point. In other embodiments, the elongated stem extends parallelly oppositely relative to the first leg and the second leg.

In some embodiments, the wheelchair accessory apparatus includes an arcuate latch pivotally connected to the first leg, a planar latch pivotally connected to the second leg, a first fastener including a spring-loaded mechanism for fastening the arcuate latch to the first leg in a nonpivotal position, a second fastener including a spring-loaded mechanism for fastening the planar latch to the second leg in a nonpivotal position, a clamp assembly for fastening the elongated stem to the wheelchair frame, and a third fastener for fastening the ambulatory assistive device support member to a footrest of the wheelchair via the sleeve of the ambulatory assistive device support. In one embodiment, the arcuate latch includes an arcuate portion.

In some embodiments, the wheelchair accessory apparatus includes an ambulatory assistive device receptacle securable to the aperture of the ambulatory assistive device support member. The ambulatory assistive device receptacle removably receives an ambulatory assistive device therein. The aperture of the ambulatory assistive device support member is sized to removably receive the ambulatory assistive device receptacle.

In some embodiments, the arcuate latch includes a first end pivotally connected to an end of the first leg and a second end that is removably attachable to an end of the second leg. In one embodiment, the first end of the arcuate latch pivotal about a central axis of the first leg.

In some embodiments, the planar latch includes a first end pivotally connected to the end of the second leg and a second end that is removably attachable to the end of the first leg. In one embodiment, the planar latch pivotal about a central axis of the second leg.

In some embodiments, the arcuate latch is offset relative to the planar latch, such that when the arcuate latch pivots about the first leg and the planar latch pivots about the second leg, rotation of the arcuate latch is not obstructed by the planar latch and rotation of the planar latch is not obstructed by the arcuate latch.

In some embodiments, the arcuate latch and the planar latch overlap when pivoting about the ends of the first leg and second leg, respectively, such that when the second end of the arcuate latch is fastened to the end of the second leg and the second end of the planar latch is fastened to the end of the first leg, the arcuate latch and planar latch are aligned and form a closed latching apparatus wherein the arcuate portion of the arcuate latch is closed off to receive and a sustain an ambulatory assistive device therein.

In some embodiments, the arcuate portion arches inwardly towards the central point of the ambulatory assistive device retaining member.

In some embodiments, the first fastener is disposed within an end of the first leg and the spring-loaded mechanism of the first fastener is biased towards the end to removably engage the first end of the arcuate latch and the second end of the planar latch.

In some embodiments, the second fastener is disposed within an end of the second leg and the spring-loaded mechanism of the second fastener is biased towards the end to removably engage the first end of the planar latch and the second end of the arcuate latch.

In some embodiments, the wheelchair accessory apparatus includes a first cap for securing the first fastener to the first end of the arcuate latch and the second end of the planar latch and a second cap for securing the second fastener to the first end of the planar latch and the second end of the arcuate latch.

In embodiments, the clamp assembly includes a pair of C-shaped members each including a first edge and a second opposing knurled arcuate edge and a fastener for fastening the pair of C-shaped members to each other around the wheelchair frame. When the C-shaped members are fastened to each other, the second opposing knurled arcuate edges face each other forming a circular opening to receive the wheelchair frame.

In some embodiments, the clamp assembly includes a second pair of C-shaped members each including a first edge and a second opposing knurled arcuate edge. The pair of C-shaped members are joined perpendicularly relative to each other at their first edges such that the second opposing knurled arcuate edges face away from each other. When used to attach the ambulatory assistive device retaining member to a wheelchair, each C-shaped member of the second pair of C-shaped members fastens to a separate C-shaped member via a fastener.

In some embodiments, the body of the ambulatory assistive device support member includes an upper face and a sidewall, wherein the cup is recessed into the upper face of the body, wherein the aperture is disposed on the upper face of the body, and wherein the sleeve is disposed on the sidewall. In one embodiment, the sleeve extends entirely through the body.

In some embodiments, the third fastener includes an elongated threaded mechanism for threadably engaging a tubing of the wheelchair footrest and a plunger for insertion into the tubing of the wheelchair footrest. Tightening of the threaded mechanism expands the plunger within the tubing of the wheelchair footrest to secure the ambulatory assistive device support member to the wheelchair footrest.

In embodiments, the ambulatory assistive device receptacle includes a stem for insertion into the aperture of the ambulatory assistive device support member and defines an interior volume for removably receiving an ambulatory assistive device therein. In some embodiments, the stem includes a threaded member for threadably engaging the aperture of the ambulatory assistive device support member and securing the ambulatory assistive device receptacle to the ambulatory assistive device support member.

For purposes of this disclosure, the following definitions are used. "ambulatory assistive device" used interchangeably with "assistive device" is defined as a mobility aid, such as wheelchair, scooter, walker, cane, crutch, prosthetic device, and/or orthotic device. "Mount" is defined as to place or fix an object or item in its operating position, or to attach the object or item to a support, or to arrange the object or item for use or display. "Thread" is defined as helical ridge on the outside of an object, such as a screw, bolt, or the like, or on the inside of a cylindrical hole, that allows two parts to be screwed together. "Threaded" is defined as an object or one or more objects joined together via a "thread." "Latch" is defined as a bar, rod, or member that is used for closing an opening. "Portal" is defined as an opening, passthrough, or entrance for the placement of an item or object. "Stem" is defined as a bar, rod, or member that is a supportive section of an item or object. "Cup" is defined as a receptacle or container including an opening providing access to interior volume for the placement of an item or object. "Knurled" is defined as an object or item having ridges on the edge of a surface, or an object that has regular ribbed markings on an edge thereof. "Spring-loaded" is defined as containing a compressed or stretched spring that exerts are force in a certain direction. "Bias" refers to the inclination of an object, thing, item, or component to return to its original position after being moved therefrom.

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

The present disclosed technology provides a wheelchair accessory apparatus comprising an ambulatory assistive device retaining member and an assistive device support member that are each removably attachable to a wheelchair. The assistive device retaining member defines a portal and the assistive device defines a cup, such that when the ambulatory assistive retaining member and the ambulatory assistive device are attached to a wheelchair, the portal and the cup are aligned for placement and retainment of an ambulatory assistive device therein while employment of the wheelchair.

Embodiments of the disclosed technology will become clearer in view of the following description of the figures.

Figure 1:
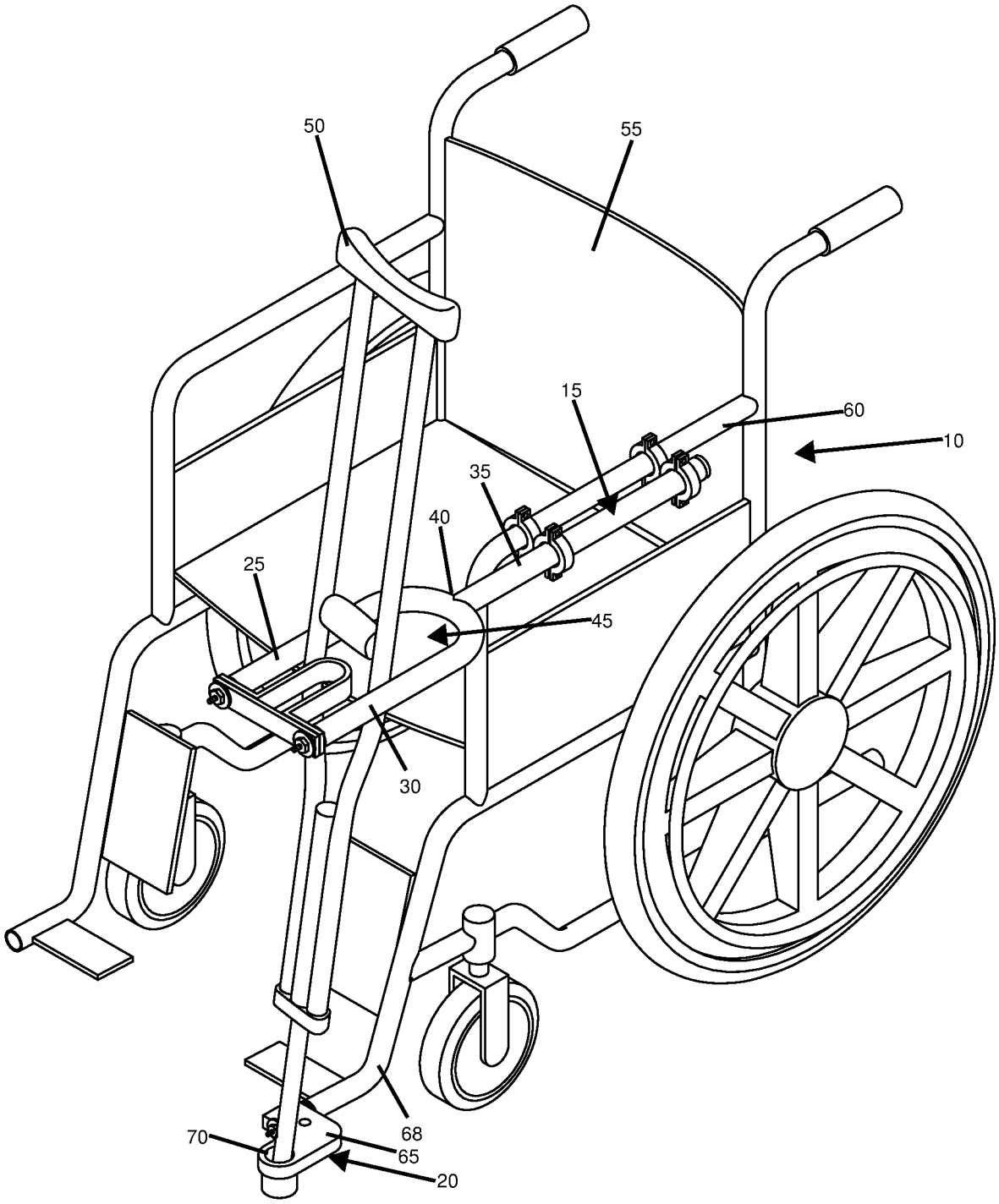
FIG. 1 shows a perspective view of the wheelchair accessory apparatus attached to an armrest of the frame of a wheelchair according to one embodiment of the present disclosed technology.
Figure 2:
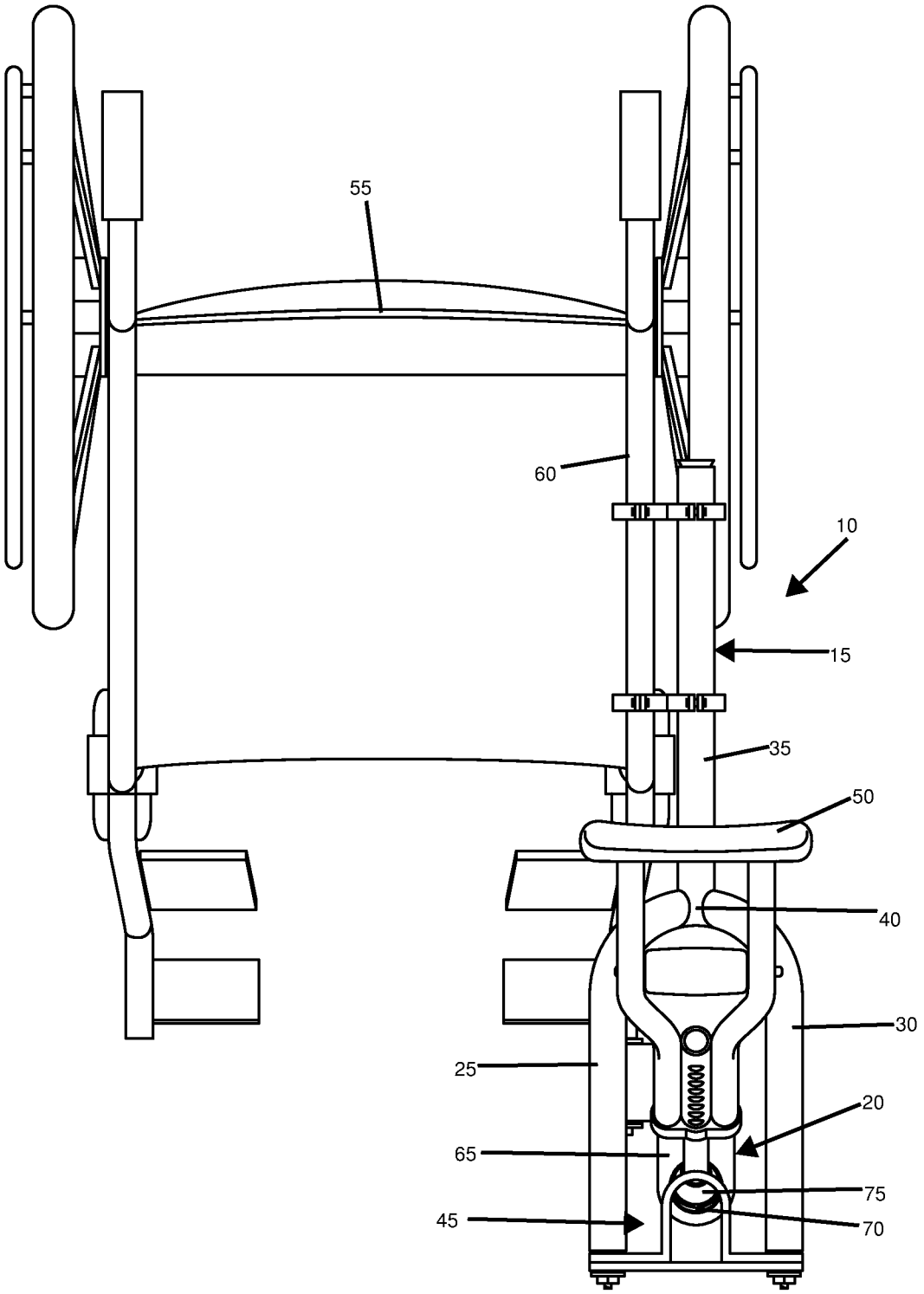
FIG. 2 shows a top down view of the wheelchair accessory apparatus attached to an armrest of the frame of a wheelchair according to one embodiment of the present disclosed technology.
Figure 3:
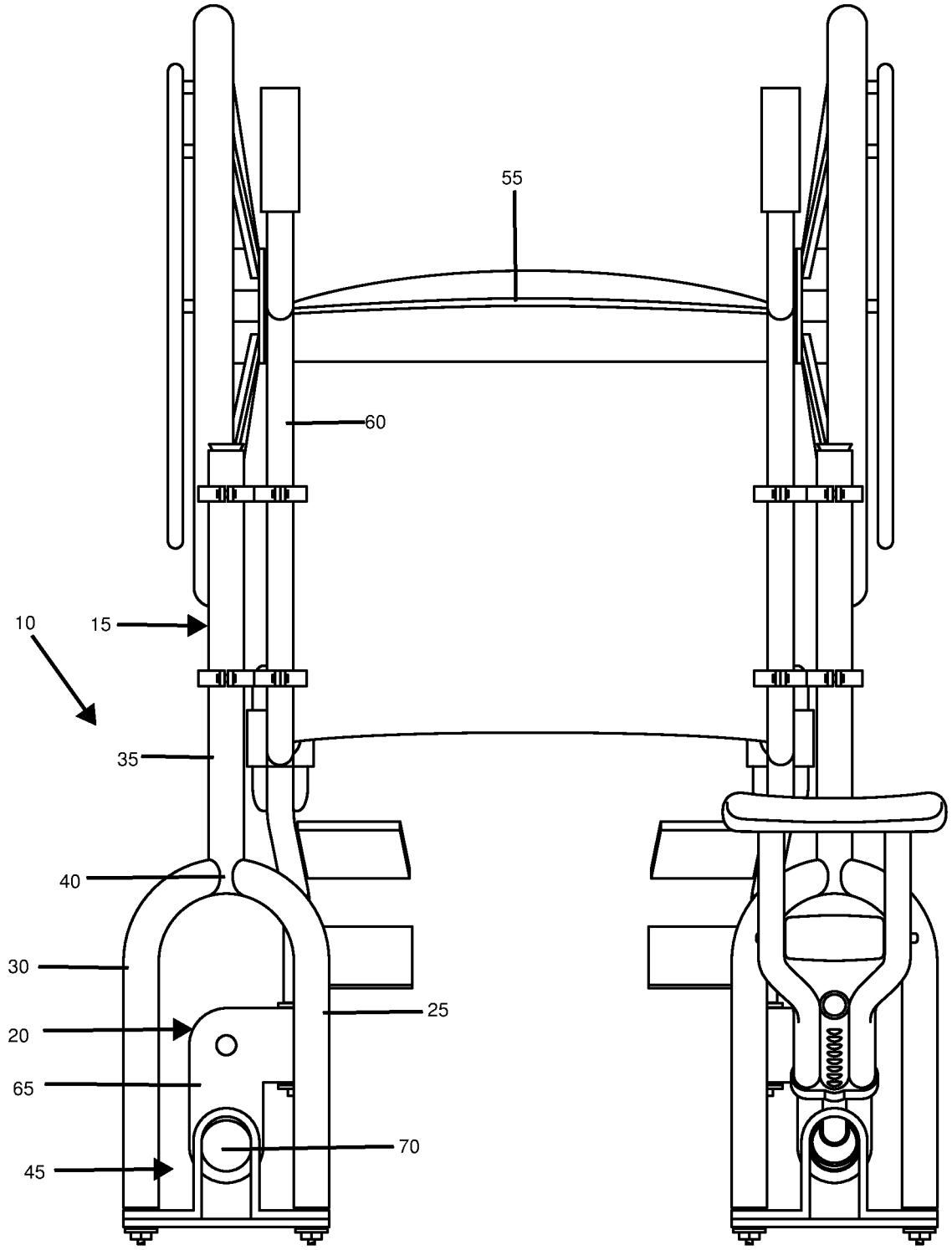
FIG. 3 shows a top down view of the wheelchair accessory apparatus attached to both armrests of the frame of a wheelchair according to one embodiment of the present disclosed technology.

Referring to the figures, FIG. 1 shows a perspective view of the wheelchair accessory apparatus attached to an armrest of the frame of a wheelchair according to one embodiment of the present disclosed technology. FIG. 2 shows a top down view of the wheelchair accessory apparatus attached to an armrest of the frame of a wheelchair according to one embodiment of the present disclosed technology. FIG. 3 shows a top down view of the wheelchair accessory apparatus attached to both armrests of the frame of a wheelchair according to one embodiment of the present disclosed technology.

The present disclosed technology provides a wheelchair accessory apparatus 10 including an ambulatory assistive device retaining member 15 that is removably attachable to the frame 60 of a wheelchair 55 and an ambulatory assistive device support member 20 that is removably attachable to the footrest 68 of the wheelchair 55.

The ambulatory assistive device retaining member 15 includes a first leg 25, a second leg 30, and an elongated stem 35. The first leg 25 and the second leg 30 join at a central point 40. The elongated stem 35 is removably attachable to a wheelchair frame 60. In one embodiment, the first leg 25, the second leg 30, and the elongated stem 35 are coplanar. In another embodiment, the first leg 25 and the second leg 30 extend outwardly and away from the central point 40 and are parallel relative to each other. The elongated stem 35 extends outwardly from the central point 40. In one embodiment, the elongated stem 35 extends parallelly oppositely relative to the first leg 25 and the second leg 30.

In one embodiment, the first leg 25 and the second leg 30 join at the central point 40 to form a U-shaped portion defining an arch therebetween, such that the central point 40 is disposed at a center of the arch, as shown in FIGS. 1-3. In another embodiment, the first leg 25 and the second leg 30 join at the central point 40 to form a V-shaped portion defining an apex at the central point 40.

The first leg 25 and the second leg 30 define a portal 45 therebetween. The portal 45 defines a space or an opening in the ambulatory assistive device retaining member 15 that receives an ambulatory assistive device 50 therethrough, thereby allowing a user to place an ambulatory assistive device in the wheelchair accessory apparatus and transport the ambulatory assistive device when employing a wheelchair 55.

The ambulatory assistive device support member 20 includes a body 65 comprising a cup 70 sized to removably receive a crutch tip 75. When the ambulatory assistive retaining member 15 is attached to the wheelchair frame 60 and the ambulatory assistive device support member 20 is attached to the footrest of a wheelchair footrest 68, the portal 45 and the cup 70 are aligned for placement and retainment of an ambulatory assistive device therein, as shown in FIG. 2. In embodiments, more than one wheelchair accessory apparatus can be attached to the frame of the wheelchair 55, as shown in FIG. 3.

Figure 4:
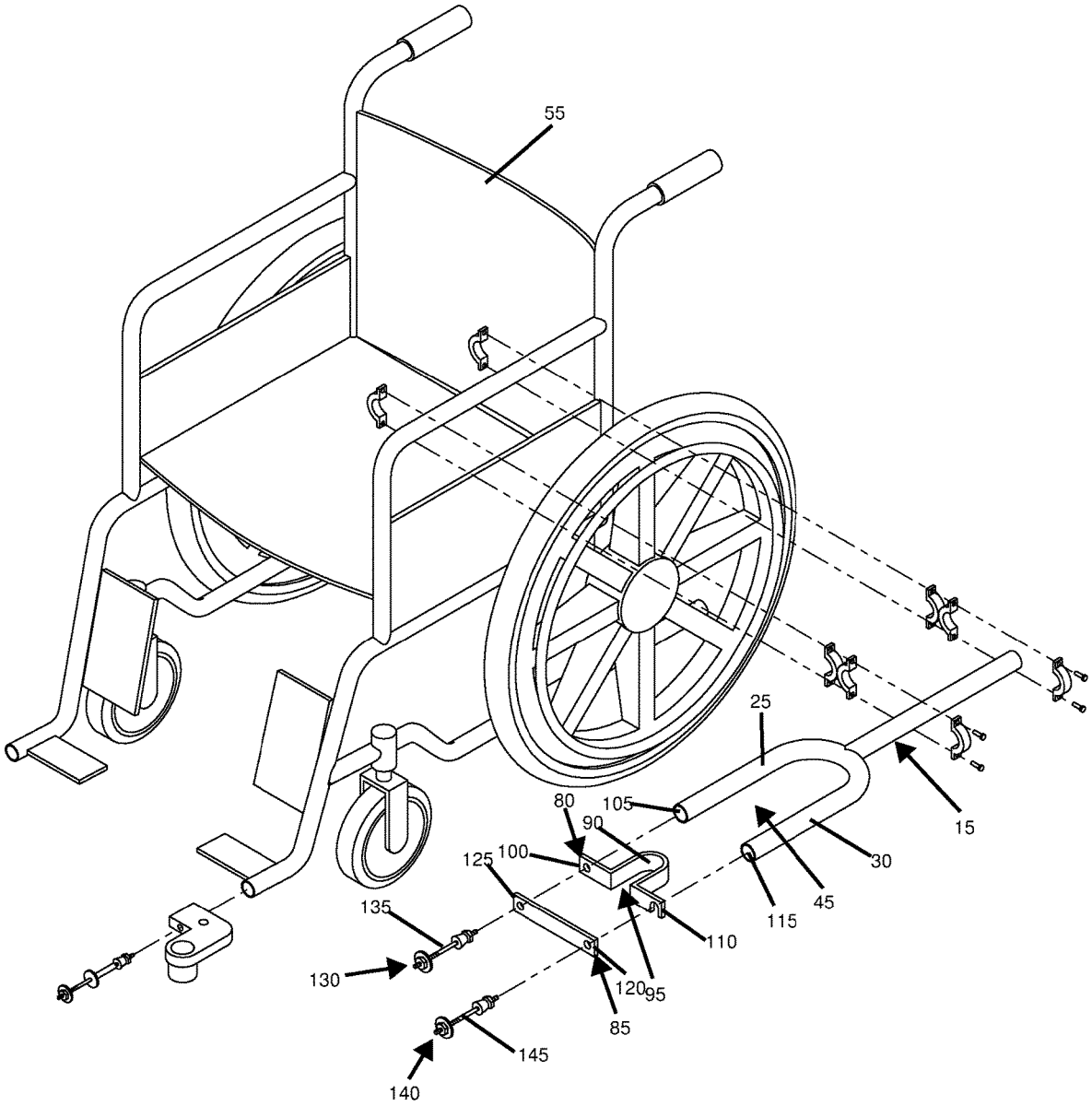
FIG. 4 shows an exploded view of the wheelchair accessory apparatus being attached to the frame of a wheelchair according to one embodiment of the present disclosed technology.

FIG. 4 shows an exploded view of the wheelchair accessory apparatus being attached to the frame of a wheelchair according to one embodiment of the present disclosed technology. In some embodiments, the wheelchair accessory apparatus 10 further comprises an arcuate latch 80 pivotally connected to the first leg 25 and a planar latch 85 pivotally connected to the second leg 30. The arcuate latch 80 includes an arcuate portion 90 that defines an opening 95 for receiving a second ambulatory assistive device therethrough. In this way, a user may transport more than one assistive device in the wheelchair 55 and has at least a pair or unique openings 45, 95 that can retain an assistive device. Further, the arcuate latch 80 enables users to create an additional space between themselves and the second assistive device they are transporting while employing the wheelchair 55. In one embodiment, the arcuate portion 90 arches inwardly towards the central point 40 of the ambulatory assistive device retaining member 15, such that the opening 95 extends into the portal 45, as shown in FIGS. 1-3.

In embodiments, the arcuate latch 80 includes a first end 100 pivotally connected to an end 105 of the first leg 25 and a second end 110 that is removably attachable to an end 115 of the second leg 30, such that the first end 100 of the arcuate latch 80 is pivotal about a central axis of the first leg 25. In other embodiments, the planar latch 85 includes a first end 120 that is pivotally connected to the end 115 of the second leg 30 and a second end 125 that is removably attachable to the end 105 of the first leg 25, such that the planar latch 85 is pivotal about a central axis of the second leg 30. In one embodiment, the arcuate latch 80 is offset relative to the planar latch 85, such that when the arcuate latch 80 pivots about the first leg 25 and the planar latch 85 pivots about the second leg 30, rotation of the arcuate latch 80 is not obstructed by the planar latch 85 and rotation of the planar latch 85 is not obstructed by the arcuate latch 80.

In one embodiment, the arcuate latch 80 and the planar latch 85 overlap when pivoting about the ends 105, 115 of the first leg 25 and the second leg 30, respectively, such that when the second end 110 of the arcuate latch 80 is fastened to the end 115 of the second leg 30 and the second end 125 of the planar latch 85 is fastened to the end 105 of the first leg 25, the arcuate latch 80 and planar latch 85 are aligned and form a closed latching apparatus wherein the arcuate portion 90 of the arcuate latch 80 is closed off to receive and a sustain an ambulatory assistive device therein, as shown in FIGS. 1-3.

Figure 6:
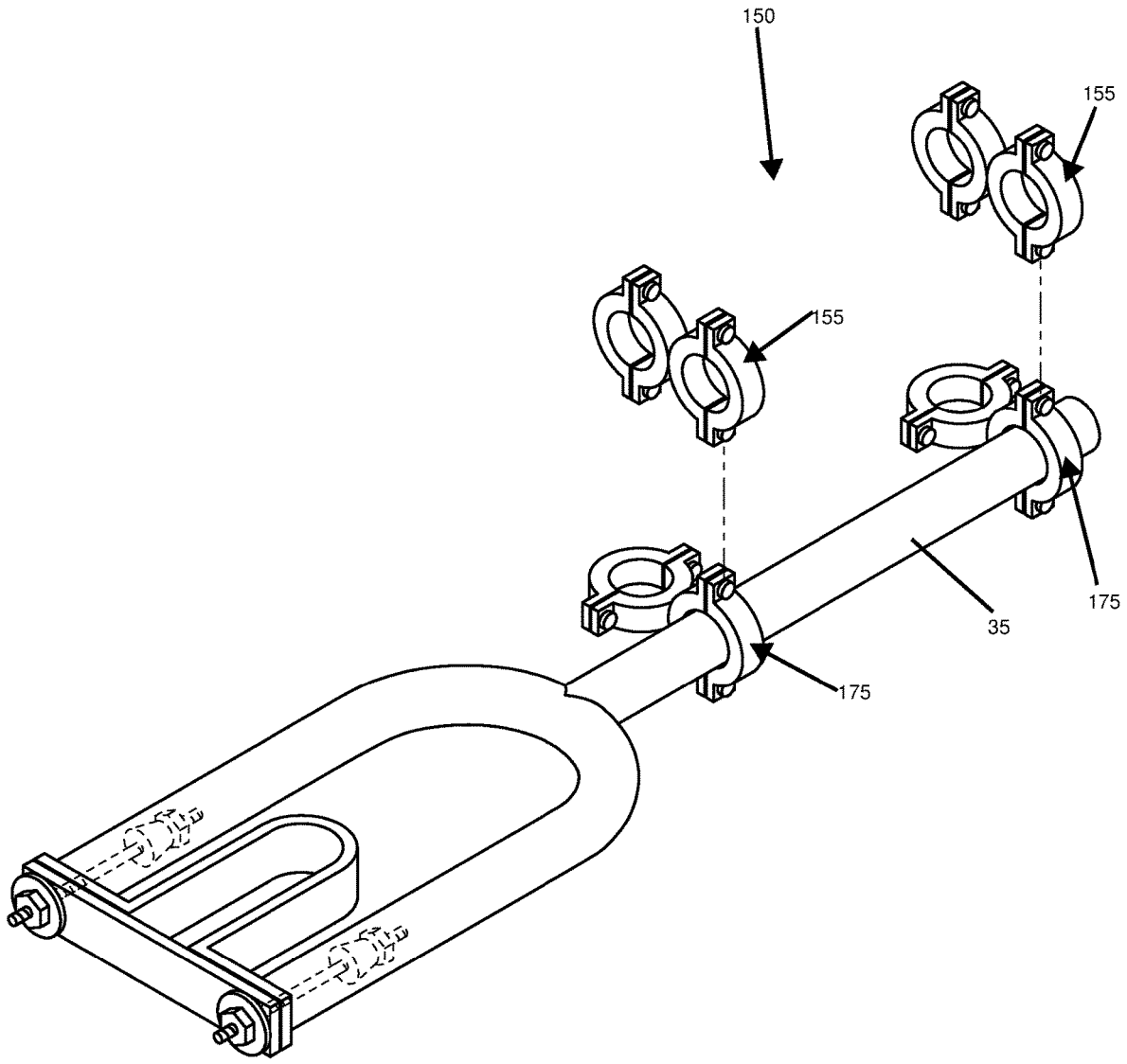
FIG. 6 shows a partial phantom and partial exploded view of the ambulatory assistive device retaining member and the clamp assembly of the wheelchair accessory apparatus according to one embodiment of the present disclosed technology.

In some embodiments, the wheelchair accessory apparatus 10 comprises a first fastener 130 including a first spring-loaded mechanism 135 to fasten the arcuate latch 80 to the first leg 25 in a nonpivotal position. In one embodiment, the first fastener 100 is disposed within the end 105 of the first leg 25 and the spring-loaded mechanism 135 is biased towards the end 105 in order to removably engage the first end 100 of the arcuate latch 80 and the second end 125 of the planar latch, as shown in FIG. 6. In one embodiment, the first fastener 130 includes a barbed mounting end cap, a spring, a threaded rod or bolt, a retaining washer, an extension sleeve, and a castle nut, which in combination form the spring-loaded mechanism 135. In another embodiment, the first fastener 130 includes any combination of the barbed mounting end cap, the spring, the threaded rod or bolt, the retaining washer, the extension sleeve, and the castle nut.

In one embodiment, the wheelchair accessory apparatus 10 comprises a second fastener 140 including a second spring-loaded mechanism 145 to fasten the planar latch 85 to the second leg 30 in a nonpivotal position. In one embodiment, the second fastener 140 is disposed within the end 115 of the second leg 30 and the spring-loaded mechanism 145 of the second fastener 140 is biased towards the end 115 to removably engage the first end 120 of the planar latch 85 and the second end 110 of the arcuate latch 80, as show in FIG. 5. In one embodiment, the second fastener 140 includes a barbed mounting end cap, a spring, a threaded rod or bolt, a retaining washer, an extension sleeve, and a castle nut, which in combination form the spring-loaded mechanism 145. In another embodiment, the second fastener 140 includes any combination of the barbed mounting end cap, the spring, the threaded rod or bolt, the retaining washer, the extension sleeve, and the castle nut.

In some embodiments, the wheelchair accessory apparatus 10 comprises a first cap for securing the first fastener 130 to the first end 100 of the arcuate latch 80 and the second end 125 of the planar latch 85, and a second cap for securing the second fastener 140 to the first end 120 of the planar latch 85 and the second end 110 of the arcuate latch 80.

Figure 5:
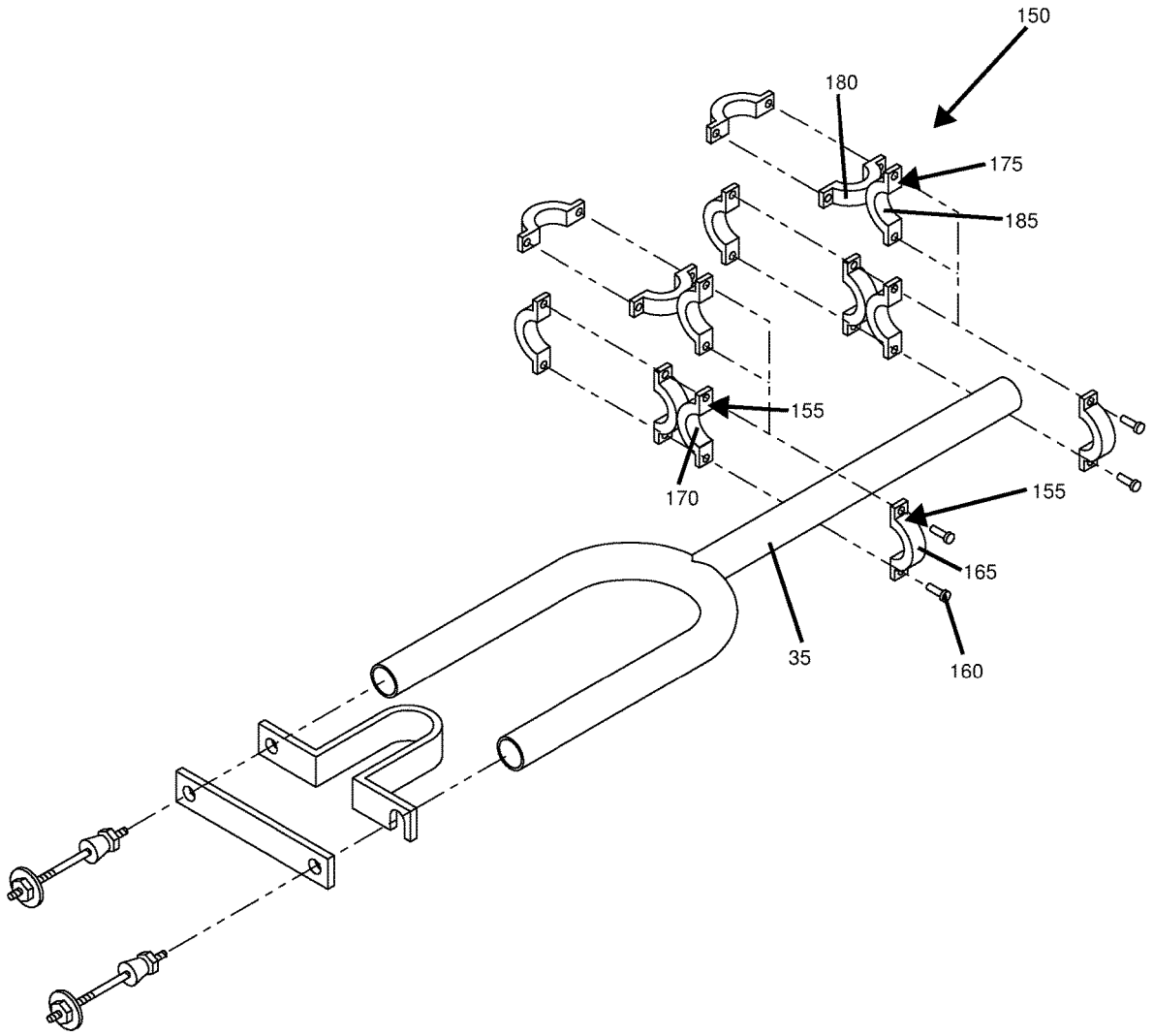
FIG. 5 shows an exploded view of the ambulatory assistive device retaining member and the clamp assembly of the wheelchair accessory apparatus according to one embodiment of the present disclosed technology.

Referring now to FIGS. 5 and 6 simultaneously, FIG. 5 shows an exploded view of the ambulatory assistive device retaining member and the clamp assembly of the wheelchair accessory apparatus according to one embodiment of the present disclosed technology. FIG. 6 shows a partial phantom and partial exploded view of the ambulatory assistive device retaining member and the clamp assembly of the wheelchair accessory apparatus according to one embodiment of the present disclosed technology. In embodiments, the wheelchair accessory apparatus includes a clamp assembly 150 for fastening the elongated stem 35 to the frame of the wheelchair. In one embodiment, the clamp assembly 150 comprises a pair of C-shaped members 155 and a fastener 160 for fastening the pair of C-shaped members 155 to each other around the frame of the wheelchair. Each of the C-shaped members 155 includes a first edge 165 and a second opposing knurled arcuate edge 170. The C-shaped members 155 fasten to each other such that the second opposing knurled arcuate edges 170 face each other forming a circular opening to receive the frame of the wheelchair.

In other embodiments, the clamp assembly 150 further comprises a second pair of C-shaped members 175 and a fastener for fastening the pair of C-shaped members 175 to each other around the frame of the wheelchair. Each of the second pair of C-shaped members 175 includes a first edge 180 and a second opposing knurled arcuate edge 185. The pair of C-shaped members 175 are joined perpendicularly relative to each other at their first edges 180 such that the second opposing knurled arcuate edges 185 face away from each other forming a semicircular opening. When mounting the wheelchair accessory apparatus 10 to the frame of a wheelchair, each of the second pair of C-shaped members 175 fastens to a separate C-shaped member 175 via the fastener.

Figure 7A:
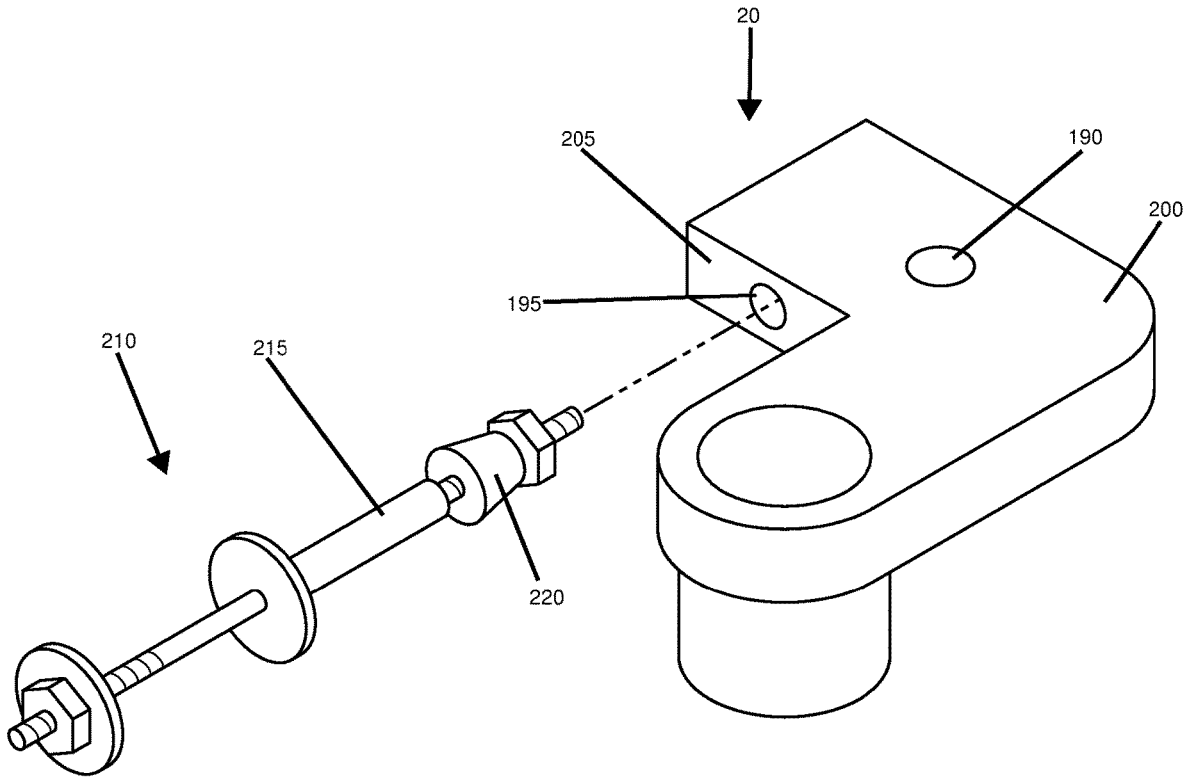
FIG. 7A shows an exploded view of the ambulatory assistive device support member of the wheelchair accessory apparatus according to one embodiment of the present disclosed technology.
Figure 7B:
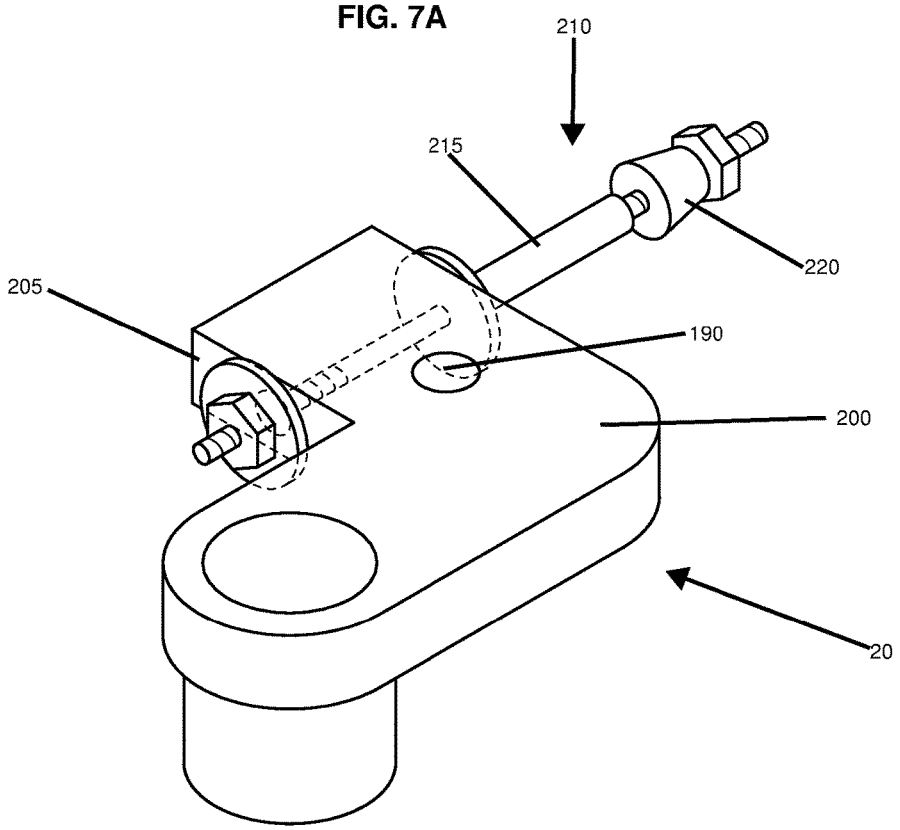
FIG. 7B shows a phantom view of the ambulatory assistive device support member of the wheelchair accessory apparatus according to one embodiment of the present disclosed technology.

Referring now to FIGS. 7A and 7B, FIG. 7A shows an exploded view of the ambulatory assistive device support member of the wheelchair accessory apparatus according to one embodiment of the present disclosed technology. FIG. 7B shows a phantom view of the ambulatory assistive device support member of the wheelchair accessory apparatus according to one embodiment of the present disclosed technology. In embodiments, the ambulatory assistive device support member 20 further includes an aperture 190 and a sleeve 195 disposed in the body 65 of the ambulatory assistive device support member 20. The body 65 includes an upper face 200 and a sidewall 205. The cup 70 of the ambulatory assistive device support member 20 is recessed into the upper face 200 of the body 65. The aperture 190 is disposed on the upper face 200 of the body 65. The sleeve 195 is disposed on the sidewall 205. In one embodiment, the sleeve 195 extends entirely through the body 65, such that it includes an opening on a first side of the sidewall 205 and a second opening on a second side of the sidewall 205. In another embodiment, the aperture 190 extends into the upper face 200 in direction opposite the direction in which the sleeve 195 extends into the sidewall 205.

In embodiments, the wheelchair accessory apparatus 10 includes a third fastener 210 for fastening the ambulatory assistive device support member 20 to a footrest of the wheelchair. The third fastener 210 is threaded through the sleeve 195 of the ambulatory assistive device support member 20, as shown in FIG. 7B, and then mounted into the tubing of the footrest of a wheelchair, as shown in FIG. 4. In one embodiment, the third fastener 210, includes an elongated threaded mechanism 215 for threadably engaging a tubing of the footrest of the wheelchair and a plunger 220 for insertion into the tubing of the footrest. Tightening of the threaded mechanism 215 expands the plunger 220 within the tubing of the footrest, thereby creating a friction fit inside the tubing of the footrest and securing the ambulatory assistive device support member 20 to the footrest, as shown in FIGS. 1-3. In other embodiments, the third fastener 210 includes a rubber cone plunger, a backing washer, a long screw, a cone plunger lock washer, and a cone plunger nut. In alternative embodiments, the third fastener 210 includes any combination of the rubber cone plunger, the backing washer, the long screw, the cone plunger lock washer, and the cone plunger nut.

Figure 8:
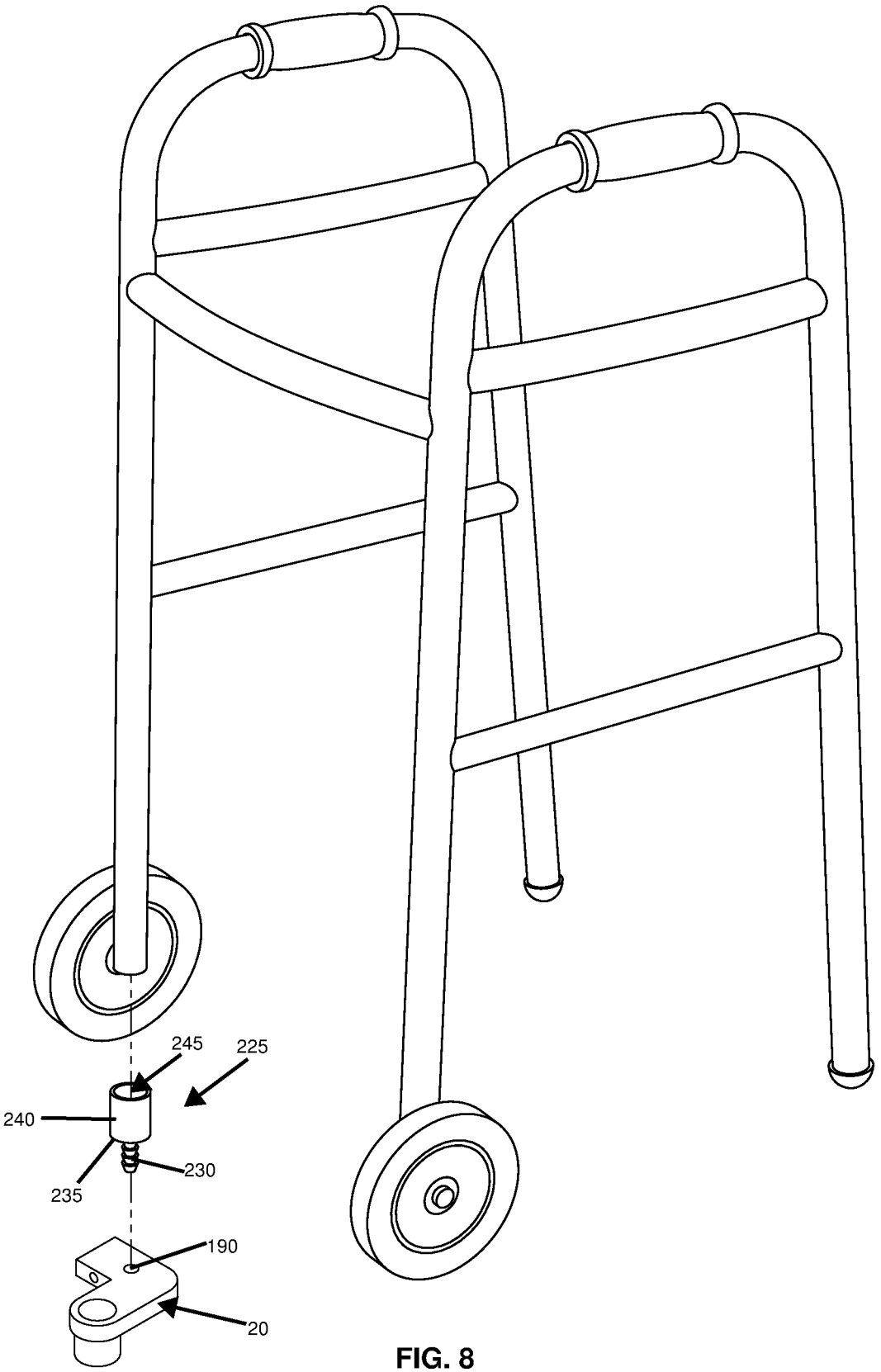
FIG. 8 shows an exploded view of the ambulatory assistive device receptacle and the ambulatory assistive device support member of the wheelchair accessory apparatus attaching to an assistive device according to one embodiment of the present disclosed technology.
Figure 9:
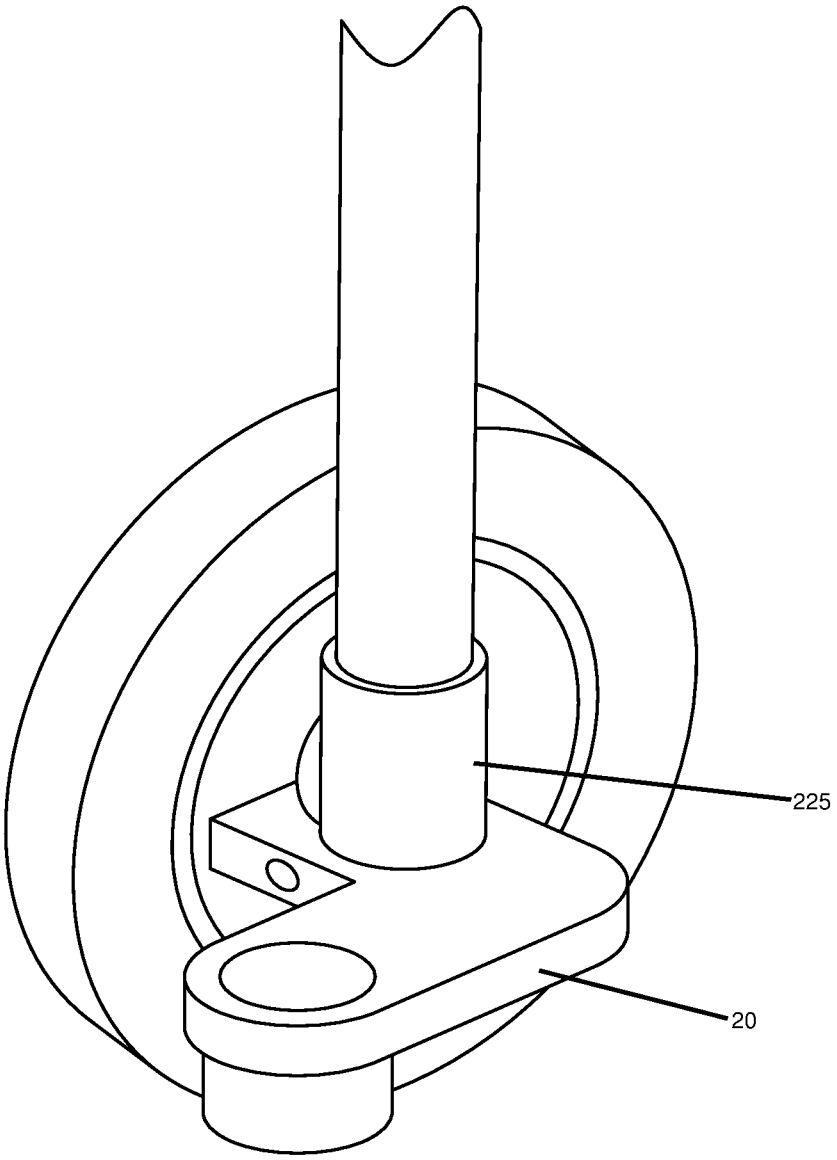
FIG. 9 shows a perspective view of the ambulatory assistive device receptacle and the ambulatory assistive device support member of the wheelchair accessory apparatus attached to an assistive device according to one embodiment of the present disclosed technology.
Figure 10:
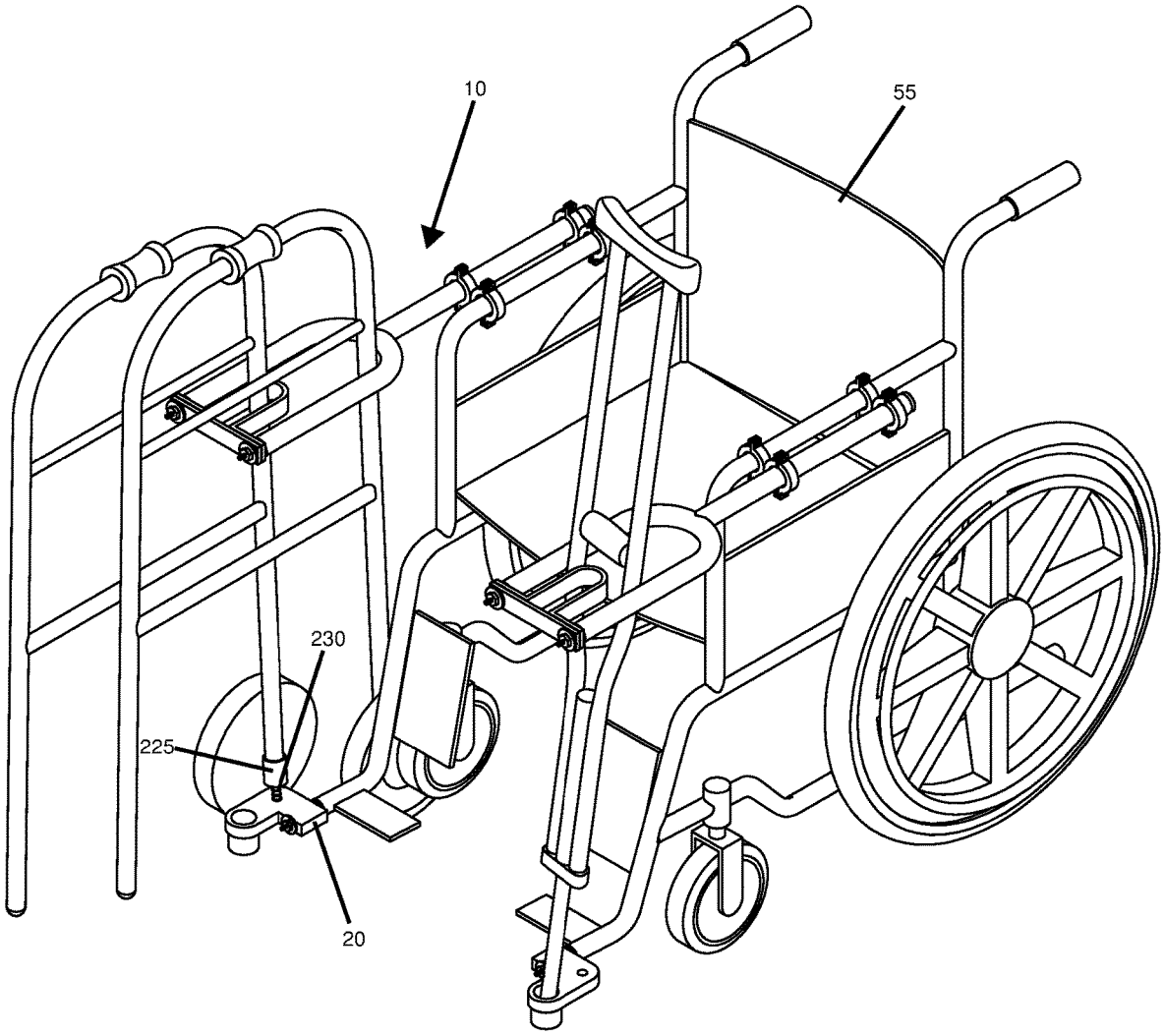
FIG. 10 shows a perspective view of the wheelchair accessory apparatus attached to both armrests of the frame of a wheelchair according to one embodiment of the present disclosed technology with the ambulatory assistive device receptacle in use according to one embodiment of the present disclosed technology.
Figure 11:
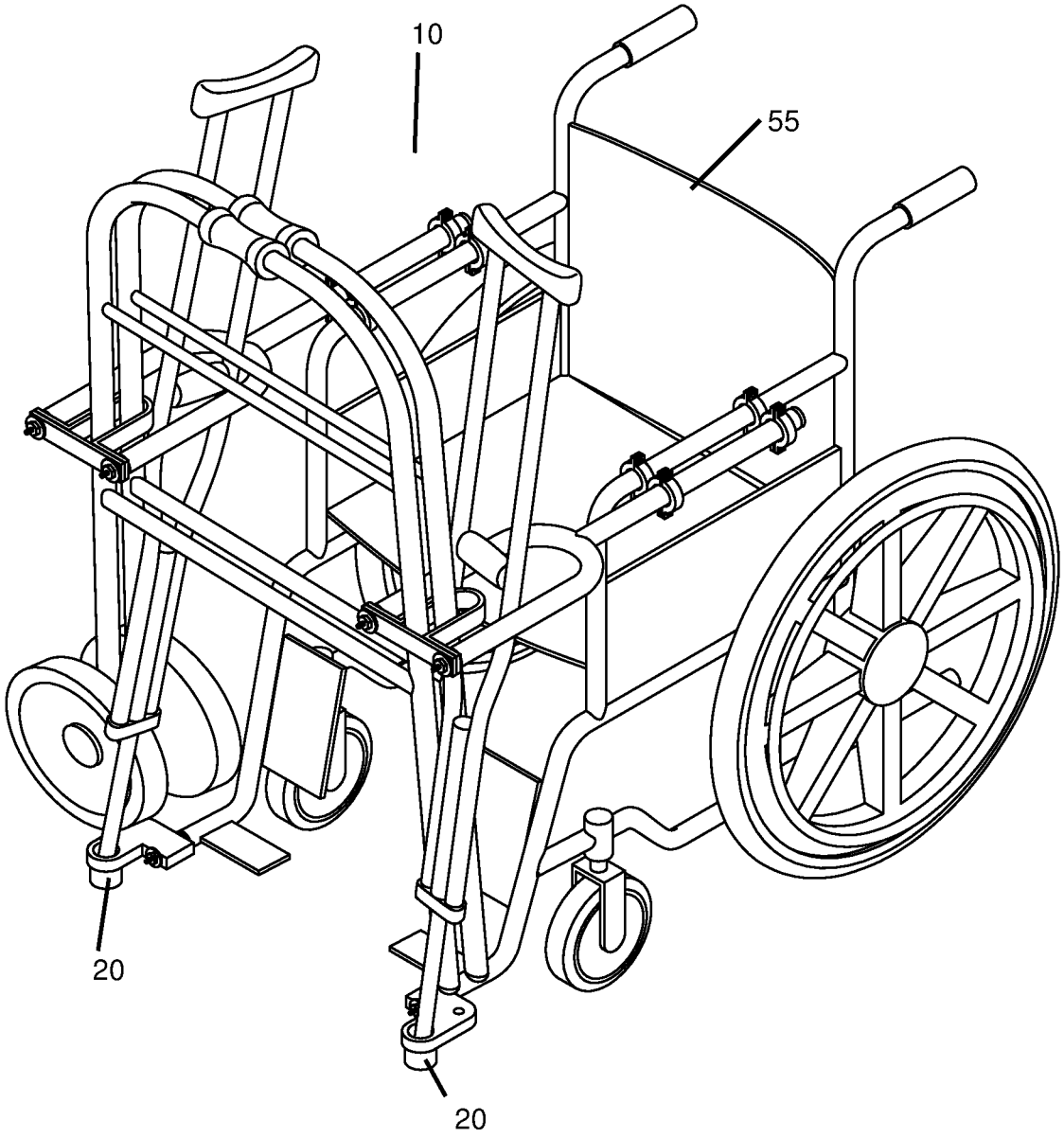
FIG. 11 shows a perspective view of the wheelchair accessory apparatus attached to both armrests of the frame of a wheelchair according to one embodiment of the present disclosed technology with the ambulatory assistive device receptacle in use according to another embodiment of the present disclosed technology.

Referring now to FIGS. 8-11 simultaneously, FIG. 8, shows an exploded view of the ambulatory assistive device receptacle and the ambulatory assistive device support member of the wheelchair accessory apparatus attaching to an assistive device according to one embodiment of the present disclosed technology. FIG. 9 shows a perspective view of the ambulatory assistive device receptacle and the ambulatory assistive device support member of the wheelchair accessory apparatus attached to an assistive device according to one embodiment of the present disclosed technology. FIG. 10 shows a perspective view of the wheelchair accessory apparatus attached to both armrests of the frame of a wheelchair according to one embodiment of the present disclosed technology with the ambulatory assistive device receptacle in use according to one embodiment of the present disclosed technology. FIG. 11 shows a perspective view of the wheelchair accessory apparatus attached to both armrests of the frame of a wheelchair according to one embodiment of the present disclosed technology with the ambulatory assistive device receptacle in use according to another embodiment of the present disclosed technology.

In embodiments, the wheelchair accessory apparatus 10 comprises an ambulatory assistive device receptacle 225 securable to the aperture 190 of the ambulatory assistive device support member 20. The ambulatory assistive device receptacle 225 removably receives an additional assistive device for transportation of the assistive device while employing a wheelchair, as shown in FIG. 10.

The ambulatory assistive device receptacle 225 includes a stem 230 for insertion into the aperture 190 of the ambulatory assistive device support member 20. The aperture 190 of the ambulatory assistive device support member 20 is sized to removably receive the ambulatory assistive device receptacle 225. The ambulatory assistive device receptacle 225 includes a base 235 and an annular wall 240 extending upwardly from a perimeter edge of the base 235. The base 235 and annular wall 240 defined an interior volume 245 for removably receiving an assistive device therein. The stem 230 includes a threaded member for threadably engaging the aperture of the ambulatory assistive device support member 20 and securing the ambulatory assistive device receptacle 225 to the ambulatory assistive device support member 20, as shown in FIG. 9. In one embodiment, the stem 230 extends perpendicularly outwardly from the base 235.

In some embodiments, an ambulatory assistive device support member 20 is attached to both footrests of the wheelchair 55, as shown in FIGS. 10 and 11. In one embodiment, each of the ambulatory assistive device support members 20 utilize the ambulatory assistive device receptacle 225 to removably receive and sustain an ambulatory assistive device, as shown in FIG. 11.

The present technology can be carried out with one or more of the embodiments described. The drawings show embodiments with the understanding that the present description is to be considered an exemplification of the principles and is not intended to be exhaustive or to limit the disclosure to the details of construction. The arrangements of the components are set forth in the following description or illustrated in the drawings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

The invention claimed is:

1. A wheelchair accessory apparatus, comprising:

an ambulatory assistive device retaining member including a first leg, a second leg, and an elongated stem, the first leg and the second leg joined at a central point and defining a portal therebetween to receive an ambulatory assistive device therethrough, the elongated stem removably attachable to a wheelchair frame; wherein the first leg, the second leg, and the elongated stem are coplanar; and an ambulatory assistive device support member including a body comprising a cup sized to removably receive a crutch tip, the ambulatory assistive device support member removably attachable to a wheelchair footrest;

wherein when the ambulatory assistive retaining member is attached to the wheelchair frame and the ambulatory assistive device support member is attached to the wheelchair footrest, the portal and the cup are aligned for placement and retainment of an ambulatory assistive device therein.

2. The wheelchair accessory apparatus of claim 1, further comprising:

an arcuate latch including an arcuate portion, the arcuate latch pivotally connected to the first leg;

a planar latch pivotally connected to the second leg;

a first fastener including a spring-loaded mechanism to fasten the arcuate latch to the first leg in a nonpivotal position;

a second fastener including a spring-loaded mechanism to fasten the planar latch to the second leg in a nonpivotal position;

a clamp assembly to fasten the elongated stem to the wheelchair frame; and a third fastener to fasten the ambulatory assistive device support member to a footrest of the wheelchair;

wherein the elongated stem extends outwardly from the central point; and wherein the ambulatory assistive device support member further includes an aperture and a sleeve wherein the third fasteners fastens the ambulatory assistive device support member to a footrest of the wheelchair the via the sleeve.

3. The wheelchair accessory apparatus of claim 2, further comprising an ambulatory assistive device receptacle securable to the aperture of the ambulatory assistive device support member, the ambulatory assistive device receptacle to removably receive an ambulatory assistive device, wherein the aperture of the ambulatory assistive device support member is sized to removably receive the ambulatory assistive device receptacle.

4. The wheelchair accessory apparatus of claim 1, wherein:

the first leg and the second leg join at the central point to form a U-shaped portion defining an arch therebetween, the central point disposed at a center of the arch; or the first leg and the second leg join at the central point to form a V-shaped portion defining an apex at the central point.

5. The wheelchair accessory apparatus of claim 1, wherein the elongated stem extends parallelly oppositely relative to the first leg and the second leg.

6. The wheelchair accessory apparatus of claim 2, wherein the arcuate latch includes a first end pivotally connected to an end of the first leg and a second end that is removably attachable to an end of the second leg, the first end of the arcuate latch pivotal about a central axis of the first leg.

7. The wheelchair accessory apparatus of claim 6, wherein the planar latch includes a first end pivotally connected to the end of the second leg and a second end that is removably attachable to the end of the first leg, the planar latch pivotal about a central axis of the second leg.

8. The wheelchair apparatus of claim 7, wherein the arcuate latch is offset relative to the planar latch, such that when the arcuate latch pivots about the first leg and the planar latch pivots about the second leg, rotation of the arcuate latch is not obstructed by the planar latch and rotation of the planar latch is not obstructed by the arcuate latch.

9. The wheelchair accessory apparatus of claim 8, wherein the arcuate latch and the planar latch overlap when pivoting about the ends of the first leg and second leg, respectively, such that when the second end of the arcuate latch is fastened to the end of the second leg and the second end of the planar latch is fastened to the end of the first leg, the arcuate latch and planar latch are aligned and form a closed latching apparatus wherein the arcuate portion of the arcuate latch is closed off to receive and a sustain an ambulatory assistive device therein.

10. The wheelchair apparatus of claim 9, wherein the arcuate portion arches inwardly towards the central point of the ambulatory assistive device retaining member.

11. The wheelchair accessory apparatus of claim 7, wherein the first fastener is disposed within an end of the first leg and the spring-loaded mechanism of the first fastener is biased towards the end to removably engage the first end of the arcuate latch and the second end of the planar latch.

12. The wheelchair accessory apparatus of claim of claim 11, wherein the second fastener is disposed within an end of the second leg and the spring-loaded mechanism of the second fastener is biased towards the end to removably engage the first end of the planar latch and the second end of the arcuate latch.

13. The wheelchair accessory apparatus of claim 12, further comprising:

a first cap for securing the first fastener to the first end of the arcuate latch and the second end of the planar latch; and a second cap for securing the second fastener to the first end of the planar latch and the second end of the arcuate latch.

14. The wheelchair accessory apparatus of claim 2, wherein the clamp assembly comprises:

a pair of C-shaped members each including a first edge and a second opposing knurled arcuate edge; and a fastener for fastening the pair of C-shaped members to each other around the wheelchair frame;

wherein when the C-shaped members are fastened to each other, the second opposing knurled arcuate edges face each other forming a circular opening to receive the wheelchair frame.

15. The wheelchair accessory apparatus of claim 14, wherein the clamp assembly further comprises a second pair of C-shaped members each including a first edge and a second opposing knurled arcuate edge, the pair of C-shaped members joined perpendicularly to each other at their first edges such that the second opposing knurled arcuate edges face away from each other, wherein each C-shaped member of the second pair of C-shaped members fastens to a separate C-shaped member via a fastener.

16. The wheelchair accessory apparatus of claim 2, wherein:

the body of the ambulatory assistive device support member includes an upper face and a sidewall;

the cup is recessed into the upper face of the body;

the aperture is disposed on the upper face of the body; and the sleeve is disposed on the sidewall, the sleeve extending through the body.

17. The wheelchair accessory apparatus of claim 16, wherein the third fastener includes an elongated threaded mechanism for threadably engaging a tubing of the wheelchair footrest and a plunger for insertion into the tubing of the wheelchair footrest, wherein tightening of the threaded mechanism expands the plunger within the tubing of the wheelchair footrest to secure the ambulatory assistive device support member to the wheelchair footrest.

18. The wheelchair accessory apparatus of claim 3, wherein the ambulatory assistive device receptacle includes a stem for insertion into the aperture of the ambulatory assistive device support member and defines an interior volume for removably receiving an ambulatory assistive device therein.

19. The wheelchair accessory apparatus of claim 18, wherein the stem includes a threaded member for threadably engaging the aperture of the ambulatory assistive device support member and securing the ambulatory assistive device receptacle to the ambulatory assistive device support member.

* * * * *